United States Patent [19]

Taylor

[11] Patent Number: 4,596,279

[45] Date of Patent: Jun. 24, 1986

[54] LOG SPLITTING APPARATUS

[76] Inventor: Glendon W. Taylor, 1047 Miner, P.O. Box 982, Idaho Springs, Colo. 80452

[21] Appl. No.: 587,053

[22] Filed: Mar. 7, 1984

[51] Int. Cl.[4] ..... B27L 7/00

[52] U.S. Cl. ..... 144/193 A; 144/193 E

[58] Field of Search ..... 144/193 R, 193 A, 193 E, 144/193 K, 3 K, 366

[56] References Cited

U.S. PATENT DOCUMENTS

| | | | |
|---|---|---|---|
| 3,974,867 | 8/1976 | Butas, Jr. | 144/193 A |
| 3,995,672 | 12/1976 | Binninger | 144/193 A |
| 4,102,373 | 7/1978 | Winiasz | 144/193 E |
| 4,239,070 | 12/1980 | Burns | 144/193 A |
| 4,294,295 | 10/1981 | Olin | 144/3 K |
| 4,310,039 | 1/1982 | O'Brien | 144/193 P |
| 4,353,401 | 10/1982 | Schilling | 144/193 A |

FOREIGN PATENT DOCUMENTS

| | | | |
|---|---|---|---|
| 233927 | 5/1961 | Australia | 144/193 A |
| 47537 | 3/1982 | European Pat. Off. | 144/193 E |
| 413580 | 5/1946 | Italy | 144/193 C |

*Primary Examiner*—W. D. Bray

*Attorney, Agent, or Firm*—Klaas & Law

[57] ABSTRACT

Apparatus for splitting a firewood log into several pieces of firewood comprising a longitudinally extended chamber adapted to receive and hold a firewood log with its grain being oriented longitudinally therein and with the chamber having an open end through which the log can be discharged; a ram means within the chamber adapted to be positioned at the end of the chamber opposite the open end and to forcibly move a firewood log placed in the chamber towards and through the open end; and a knife means traversing the open end having a plurality of blades which engage and split the firewood log into several pieces as it moves through the open end.

16 Claims, 11 Drawing Figures

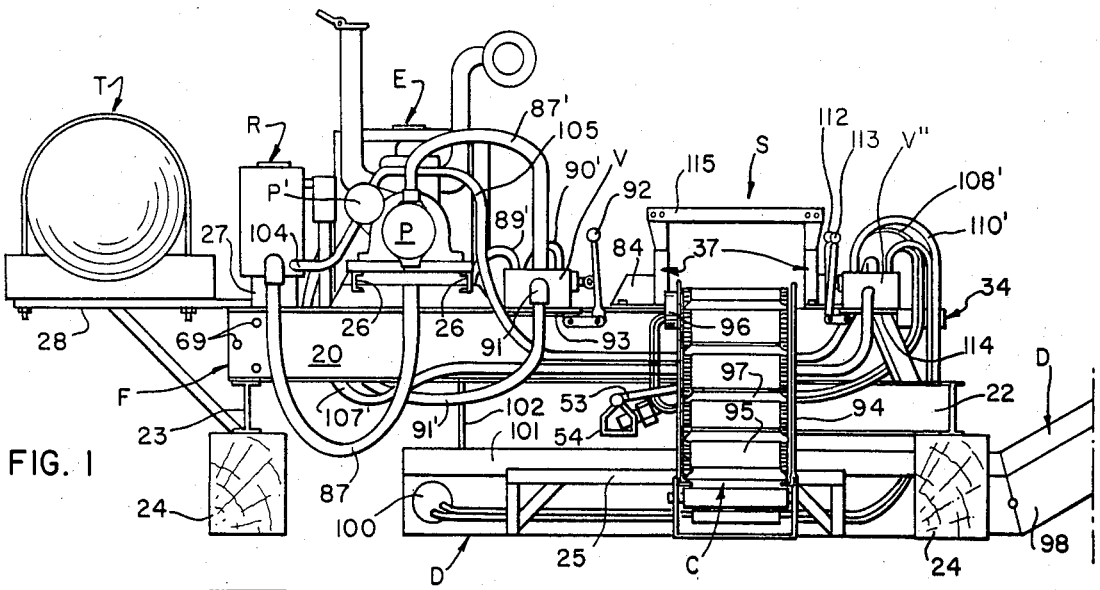
FIG. 1
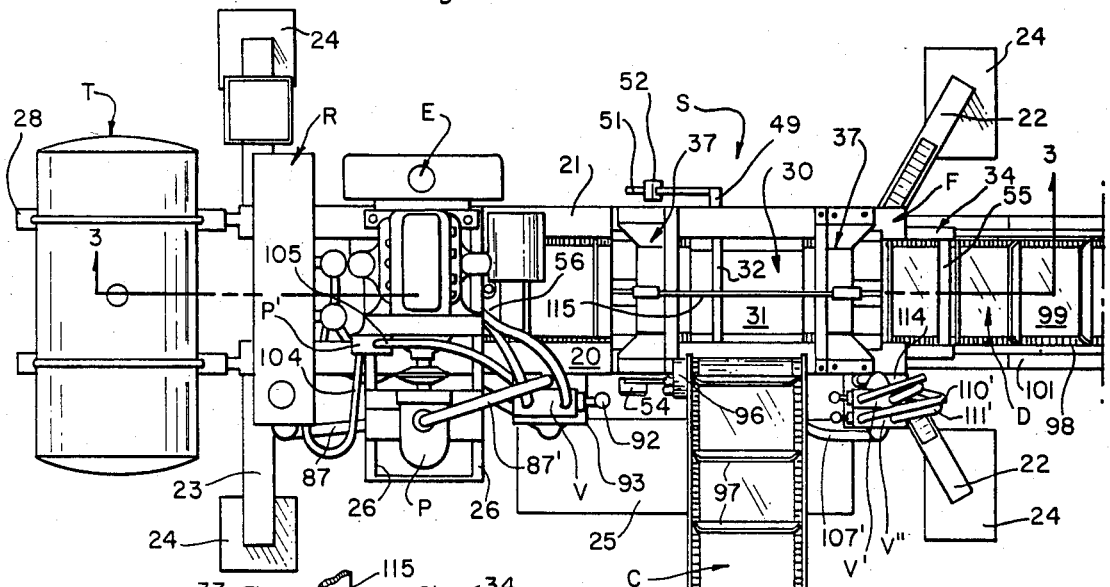
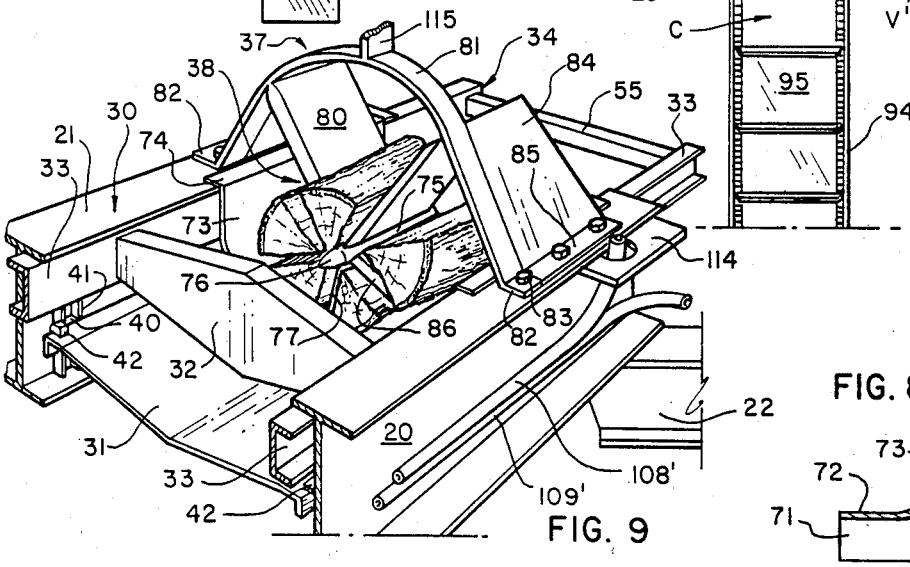
FIG. 9
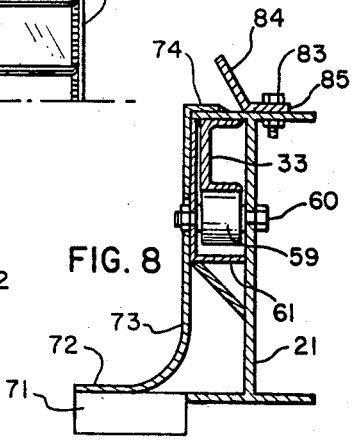
FIG. 8

LOG SPLITTING APPARATUS

The present invention relates to log splitting apparatus and more particularly to apparatus for splitting firewood logs. As such, the invention will be hereinafter called "a log splitting apparatus" and sometimes simply a "splitter". Reference is made to my disclosure document received by the Patent Office dated Mar. 24, 1983, Ser. No. 115,862.

The primary object of the invention is to provide a novel and improved log splitting apparatus which is adapted to split comparatively short, large-diameter firewood logs into a number of pieces, not merely in half as does conventional splitters.

An important need for a splitter for large diameter firewood logs has come about because the ever growing demand for firewood has increased its value to a point approaching the value of dimension lumber. Thus, a sawmill can create a market for timber sticks which will not make good dimension lumber. Frequently, a timber stick will wind, or have excessive knots, or be full of pitch or even be badly checked and good only for firewood. The problem, insofar as a sawmill is concerned, is that the timber is usually too large in diameter for firewood and once a firewood log is cut to length it must be split into a number of pieces. This requires repeated handling with a conventional type splitter even when the splitter is large enough to split the log. For this reason, a sawmill may be unable to compete with an operation which cuts only firewood because that operation will use smaller trees for the firewood logs that need to be split only once, if at all.

It follows that there is a real and definite need for an improved log splitting apparatus which can split comparatively large-diameter firewood logs into a number of pieces in a single operation and handle the logs and firewood pieces in a rapid, efficient manner. With such and other considerations in view, the present invention was conceived and developed and comprises in essence: a longitudinally extended chamber to receive a firewood log with its grain being longitudinal therein, a radial array of splitting knives, hereinafter called a spider, at one end of the chamber and a ram at the other end of the chamber to move across the chamber and push the firewood log through the spider of knives and split it into a number of pieces. To enhance this basic organization, the center or nave of the spider is a cylindrical pointed rod at a longitudinal central axis of the chamber and the chamber includes an adjustable floor to align center the firewood log with the nave. To render the organization more efficient, a spider is mounted at each end of the chamber and the ram is double acting to move across the chamber in either direction to alternately push firewood logs through both spiders. To complete the organization a suitable conveying apparatus is provided to bring firewood logs to the chamber and to remove the split firewood as it falls away from the spider knives.

Other objects of the invention are to provide a novel and improved log splitting apparatus capable of splitting a large diameter firewood log into a number of pieces which: permits a continuous movement of firewood logs into and split firewood out of the apparatus; can be constructed to split a large diameter firewood log into four, five or six pieces but at the same time can split a smaller diameter firewood log into only two pieces; can be constructed to operate by manual controls or with semi-automatic controls; permits a sawmill to competitively cut waste logs into firewood; can be designed to split logs for other purposes, as where the split pieces must be straight-grained; is basically simple in construction and operation; and, is a rugged, durable and economical unit.

With the foregoing and other objects in view, all of which more fully hereinafter appear, my invention comprises certain constructions, combinations and arrangements of parts and elements as hereinafter described, defined in the appended claims and illustrated, in preferred embodiment, in the accompanying drawing in which:

FIG. 1 is a side elevational view of the wood splitter showing portions of a supply conveyor and discharge conveyor.

FIG. 2 is a plan view of the wood splitter and the supply and discharge conveyor portions shown at FIG. 1.

Figures 3, 5, 6, 7:
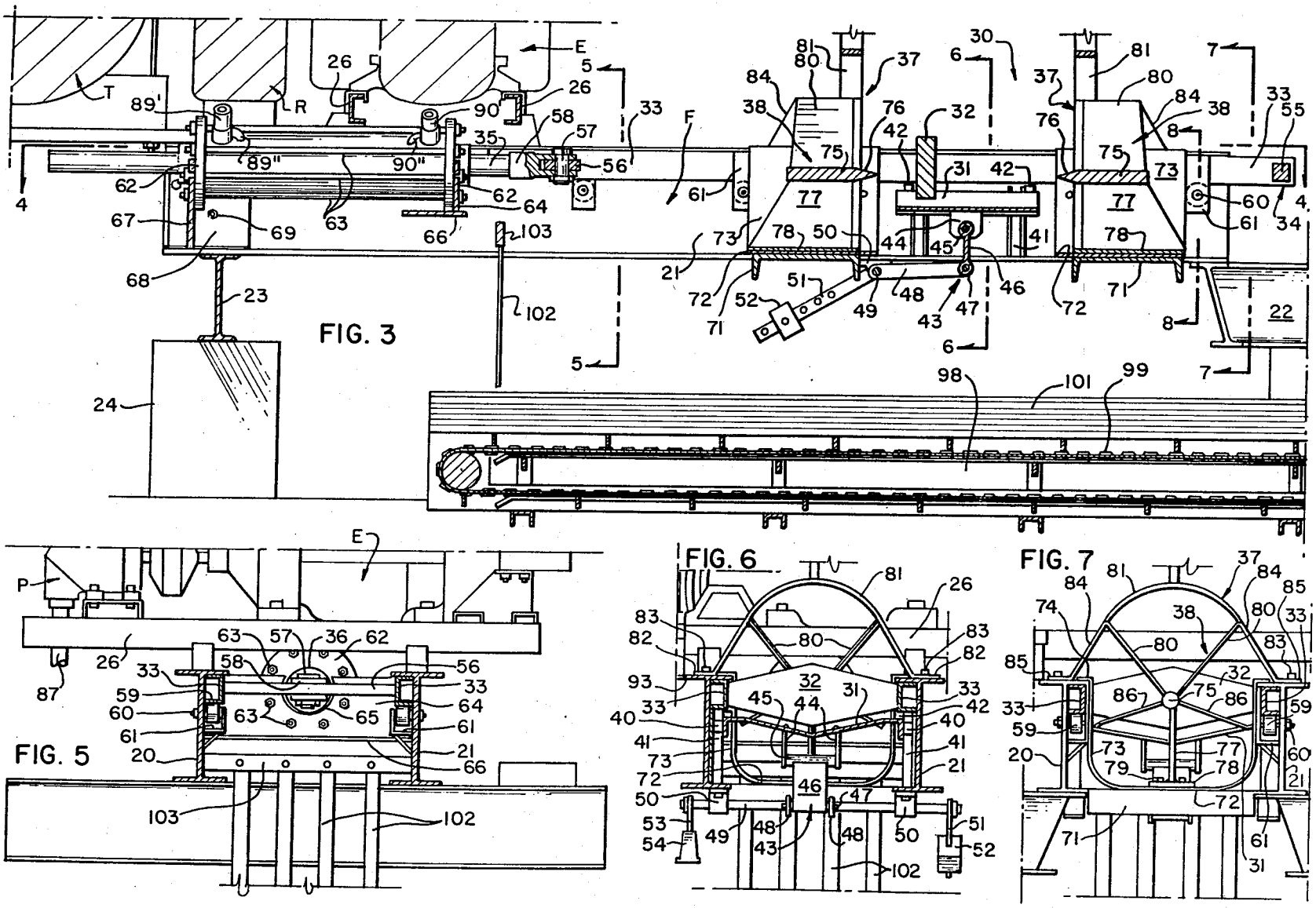
FIG. 3 is a longitudinal sectional elevational view as taken from the indicated line 3—3 at FIG. 2 but on an enlarged scale.

FIGS. 5, 6 and 7 are transverse sectional elevational views as taken from the respective indicated lines 5—5, 6—6 and 7—7 at FIG. 3.

FIG. 8 is a fragmentary sectional detail as taken from the indicated line 8—8 at FIG. 3 but on a further enlarged scale.

FIG. 9 is a sectional perspective view of a portion of the splitter as looking from the indicated arrow 9 at FIG. 3 but with a firewood log having been pushed through the spider element and thereby split into five pieces.

Figures 4, 10, 11:
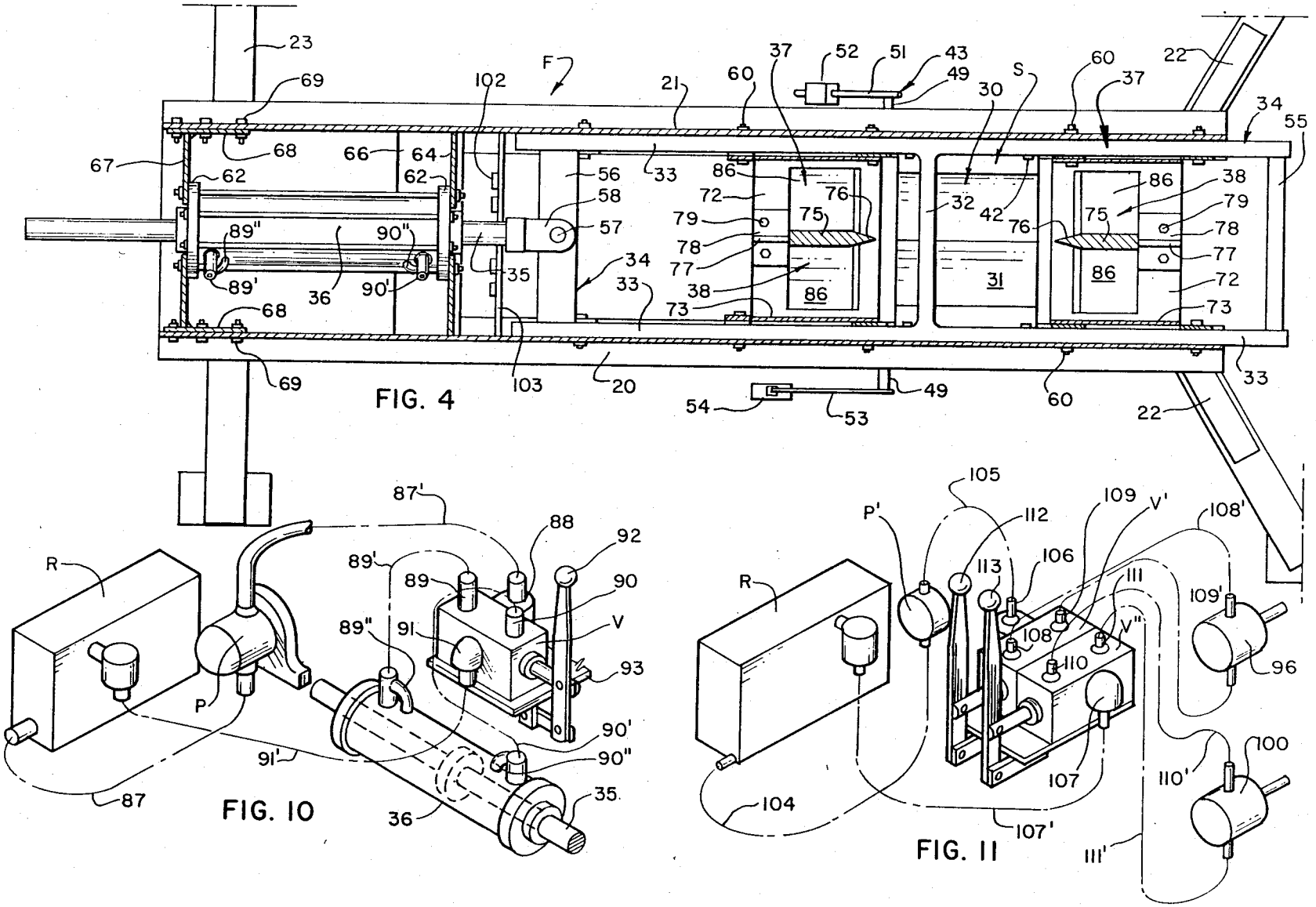
FIG. 4 is a sectional plan view as taken from the indicated line 4—4 at FIG. 3 but with conveyor elements below the main frame portion, being omitted.

FIG. 10 is a diagrammatic view of the hydraulic system used to actuate and operate the ram element of the splitter.

FIG. 11 is a diagrammatic view of the hydraulic system used to actuate and operate the supply and discharge conveyors of the splitter.

The log splitting apparatus is preferably operated by an hydraulic system with pressurized fluid driving the splitter ram and conveyor motors as hereinafter described. Pressurized fluid may be provided from any suitable source but preferably the apparatus will include an engine to provide power to fluid pumps, a fuel tank and a fluid reservoir. With this arrangement the apparatus may be used at isolated locations where other power sources such as electricity are not available.

Referring more particularly to the drawings, the log splitting apparatus is mounted upon a longitudinally extended, horizontally disposed frame F. The primary members of this frame are two comparatively large I-beams 20 and 21 which are held apart in spaced parallelism by cross members hereinafter described. Each I-beam 20 and 21 extends substantially the length of the apparatus and is supported at each end by transverse beam members including a strut arm 22 at the discharge end of each beam member, 20 and 21, to outstand from its beam member as illustrated. A transverse support beam 23 is located at the opposite end of the I-beam members. To provide suitable ground clearance for a discharge conveyor, hereinafter described, the outstanding end of each strut arm 22 and the ends of the support beam 23 are mounted upon suitable posts or pillars 24 as illustrated. Finally, a platform 25 is provided alongside the frame beam 20 where an operator may stand when the apparatus is in operation.

The components carried upon the frame F include the splitter mechanism S which is positioned upon and between the I-beams 20 and 21 adjacent to the discharge end of the frame. An engine E, a fluid reservoir R and a fuel tank T are mounted upon the frame F adjacent to the opposite end of the frame. These components may be mounted on the frame in any suitable arrangement such as that illustrated, as with the engine E being carried upon cross beams 26 secured to the I-beams, the fluid reservoir being mounted upon clips 27 upstanding from the beam members 20 and 21 and the fuel tank being mounted upon braced struts 28 extended beyond the ends of the frame members. A supply conveyor C extends laterally towards and over the frame beam 20 to drop firewood logs into the splitter mechanism S. A discharge conveyor D extends longitudinally underneath the frame F and from the discharge end of the frame to receive split firewood as it drops from the splitter mechanism, all to convey the firewood to a storage or loading facility not shown. Other components will include hydraulic lines, hereinafter designated, which extend from the reservoir R to pumps P and P' at the engine E, thence to control valves V, V' and V'' alongside the frame beam 20, thence to operating components at the splitter mechanism S and conveyors C and D and thence to the reservoir R, all as more fully hereinafter described.

The splitter mechanism S includes a chamber 30 in the space between the longitudinally disposed I-beams 20 and 21. A firewood log, oriented with its grain being longitudinal, will drop from the supply conveyor C into the chamber 30 and onto a floor plate 31. This floor plate 31 is sloped from each side to form a shallow trough at its center to better align and laterally center a firewood log within the chamber. A transverse ram bar 32 spans the chamber above the floor plate and each end of this ram bar is connected to a longitudinal member 33 of a slide frame 34 which extends about and within the chamber 30 with the opposing longitudinal side members 33 being underneath the opposing upper flanges of the I-beams 20 and 21, thereby forming sidewalls of the chamber 30. The slide frame 34 is connected to the piston 35 of a double acting cylinder 36 which is longitudinally disposed between the I-beams 20 and 21 in that portion of the frame F underneath the engine E. Cyclic movement of the piston 35 will move the ram bar 32 back and forth within the chamber 30 to push a firewood log, longitudinally, from either end of the chamber. To complete the splitter mechanism S a splitter head 37, is positioned at each end of the chamber 30. Each splitter head carries a spider 38 of splitter knives, hereinafter further described. A firewood log is pushed through a spider 38 by the ram bar 32 to be split into several pieces as illustrated at FIG. 9. It is to be noted that the ram bar 32, the slide frame 34, the piston 35 and the spiders 38 are aligned on a common central longitudinal axis within the chamber, the chamber axis. Thus, the forces exerted by the piston 35 in splitting firewood logs are common in alignment and are balanced to eliminate any tendency of the mechanism to bind.

A firewood log is centered laterally by the floor plate trough and the floor plate 31 is adapted to be raised or lowered to center the firewood log within the chamber at the aforementioned chamber axis and in axial alignment with the spider 38 through which it will be pushed. To keep the floor plate in position within the chamber a lug 40 outstands from each side of the plate 31 adjacent to each corner thereof. Each lug is slidably fitted into a vertical, channel-shaped guideway 41 which is affixed to the web of the adjacent I-beam 20 or 21 below the longitudinal slide frame member 33. A second lug or stop 42 is mounted at each corner of the floor plate 31 to limit the upward movement of the floor plate by engaging the underside of the slide frame member 33.

The floor plate 31 is biased to move upwardly when the chamber is empty by a levered counterweight mechanism 43 which yields to the weight of a firewood log in the chamber 30 to permit the floor plate 31 to lower until the log is centered with respect to the spider 38. As best shown at FIGS. 3 and 6, the mechanism 43 includes transversely spaced ears 44 depending from the underside of the floor plate 31 to carry a transverse pintle 45 directly below the center of the floor plate. A comparatively wide link 46 depends from this pintle to carry a second pintle 47. One end of a correspondingly wide double-strap lever 48 pivotally connects with the ends of the pintle 47 which project from the link 46. This lever, which lies approximately horizontally, is fastened to a transverse shaft 49 which is secured to the undersides of I-beams 20 and 21 by bearings 50. It is to be noted that this comparatively wide linkage fastened to the shaft 49 will stabilize the floor plate 31 against lateral pressure as when a log falls into the chamber.

The end of the shaft 49, which projects a short distance from the I-beam 21, carries an inclined lever arm 51 which, in turn, carries a counterweight 52 adjustable to various positions on the lever arm 51. The lever arm 51 is directed oppositely to the lever 48, thus the counterweight 52 will lift the floor plate 31 and its effective lifting force will increase as the floor plate 31 is lowered as by the weight of a firewood log. Thus by adjusting the position of the counterweight 52 upon the inclined arm 51, the floor plate 31 can be made to position different sized logs, of different weights, to, or approximately to, alignment with a splitting spider 38. To supplement the action of the lever arm 51, the other end of the shaft 49 which projects a short distance from the I-beam 20, carries a lever arm 53 having a stirrup 54 at its end to permit an operator standing on the platform 25 to place his foot in the stirrup to push downwardly to rotate the shaft 49 to raise the floor plate 31 or to lift upwardly to rotate the shaft 49 in the opposite direction to lower the floor plate 31.

The stirrup 54 permits an operator to adjust the floor plate 31 to better center a firewood log for splitting by pushing it through a spider 38. It supplements the action of lever arm 51 and counterweight 52 which is sometimes necessary because firewood logs vary in diameter, density and shape. It is to be noted that a skilled artisan can devise and build mechanisms in lieu of the mechanisms above described which function in the same manner and are fully equivalent thereto, however the mechanisms above described are simple and act quickly.

Once a firewood log is in the chamber and the elevation of the floor 31 is proper, the transverse ram bar, positioned at one end of the chamber, will push the log through the spider 38 at the opposite end of the chamber. It is to be noted that the ram bar 32 will be at an end of the chamber when a firewood log is dropped into the chamber and the firewood logs must be cut four or five inches shorter than the length of the chamber to provide for proper clearance for the ram bar 31.

The slide frame 34, carrying the ram bar 32 between its longitudinal side members 33, extends beyond each end of the chamber and beyond the structures forming the spiders 39. The outer end of the slide frame 34 extends beyond the discharge end of the frame F and a transverse end bar 55 connects with the ends of the side members 33. The inner end of the slide frame 34, between the I-beams 20 and 21, extends to a position below the engine E, as shown at FIG. 3, and a transverse, comparatively-heavy cross bar 56 connects with the ends of the side members 33. This cross bar 56 also connects with the piston 35 as by a pin 57 and coupling 58 on the end of the piston. The longitudinal side members 33 of the slide frame 34 are supported upon rollers 59 carried upon shafts 60 suitably spaced along the I-beams 20 and 21 as shown at FIG. 3. One end of each shaft 60 is connected to the web of its I-beam and the other end of each shaft is supported upon a bracket 61 welded to the web of its I-beam, 20 and 21, as best shown at FIG. 8.

The cylinder 36 is longitudinally and centrally mounted at the chamber axis between the I-beam frame in the section underneath the engine E and the fluid reservoir R. It is positioned at an elevation which aligns its piston with the slide frame 34. End caps 62 on the cylinder 36 are held together by longi-tudinal end nuts on threaded rods 63, some of which also connect with upright cross plates between the I-beams 20 and 21. A cross plate 64, at the forward piston end of the cylinder, is welded to the web and to the underside of the upper flange of each I-beam 20 and 21. A central circular notch 65 at the upper edge of the cross plate 64 receives the central portion of the forward end cap 62 and suitable holes about this notch receive the ends of the rods 63 as illustrated at FIG. 5. This upright cross plate 64 is reinforced by a horizontally disposed plate 66 welded to its under edge and to the webs of the I-beams, all to better resist the thrust force of the cylinder. A second cross plate 67 is positioned at the rearward end of the cylinder. This plate includes clips 68 welded to each end thereof, which are bolted to the webs of the I-beams 20 and 21 as at 69. The plate 67 also includes a circular notch 70 which receives the central portion of the rearward end cap 62 and suitable holes about this notch receive the ends of the rods 63.

Each splitter 37, positioned at an end of the chamber 30, is mounted upon a floor 71 between the I-beams 20 and 21 which is conveniently formed by a wide, short channel beam having the ends of its web abutting and being welded to the edges of the lower I-beam flanges. A passageway channel above this floor is formed by a liner 72 having its central portion at the floor 71, a sidewall 73 at each side extending upwardly to the edge of the upper I-beam flange above it and a lip 74 which folds over and onto the top surface of the flange where it is secured thereto in any suitable manner as by welding. The splitter knives, forming the spider 38, extend radially about a central nave 75 at the chamber axis. The nave is a short, longitudinally-disposed cylindrical rod having a conical point 76 projecting into the chamber 30 a short distance ahead the knives 38, but such that the ram bar 32 does not touch the point. The best splitting action was found to occur whenever a log is positioned so that the center of the log engages the point 76 before splitting commences The conical point of the nave cylinder penetrates a log and applies a spreading pressure to the log before the knives commence to act. This reduces the force needed to complete the splitting.

The spider 38 may have four, five or six knives about the nave 75 although five evenly spaced knives, as shown, is a preferred arrangement. Each knife is a flat plate-like member, quadrilateral in form, with a sharp leading edge. Each knife is proportioned to withstand the pressures imposed upon it when a firewood log is pushed through the spider. The inner edge of each knife is securely welded to the cylindrical nave 75 and the outer edge of each knife is securely welded to an anchor means which, in turn, is secured to the frame F to hold the spider in place. A central base knife 77 depends from the nave 75 and has a longitudinally disposed foot 78 at its lower outward edge which engages the liner 72 and is secured to the liner and to the floor 71 beneath the liner by bolts 79.

The two upper knives 80 are spread apart with each being inclined approximately 36 degrees from the vertical. An arch 81, a rigid curved bar, is transversely disposed above the frame F and is connected, as by welding, to the upper outer edge of each knife 80 adjacent to the sharpened leading edge of each knife. Each end of the arch 81 is bent to form a foot 82 which rests upon the top flange of an I-beam, 20 or 21, and this foot is fastened to the flange by a bolt 83. To reinforce the arch 81 a gusset plate 84 is connected, as by welding, to the trailing edge of the lower portion of each arch and to the upper outer edge of the adjacent knife 80. The base of each gusset plate is bent to form a foot 85 which rests upon the upper flange of an I-beam, 20 or 21, alongside the foot 82 and is connected to the flange by bolts 83.

The two intermediate knives 86 are spread apart with each being inclined approximately 72 degrees from the vertical base knife 77. The outer edge of each intermediate knife 86 is secured to the sidewall 73 of the liner, as by welding. It is to be noted that all of the knives 77, 80, and 86 are securely fastened to the liner 72 or the reinforced arch 81. The liner and arch are connected to the frame F to thus form a yoke or structural anchor means to hold the knives in place and to resist forces imposed on them, especially when a firewood log having knots is pushed through the spider.

The hydraulic system to operate the piston 35, to move the ram bar 32 in chamber 30, includes the pump P at engine E and the valve V, heretofore mentioned. These are conventional components and need not be described in detail. Referring to FIGS. 1, 2, and 10, and intake line 87 extends from the fluid reservoir R to the intake port of pump P. A pressure line 87' extends from the discharge port of pump P to the intake port 88 of Valve V. The valve V is a lever-operated 4-way spool valve having also working ports 89 and 90 and a discharge port 91. A work line 89' extends from port 89 to one end of the cylinder 36 and a work line 90' extends from port 90 to the other end of cylinder 36. A return line 91' extends from the discharge port 91 to the fluid reservoir R to complete the circuit.

The 4-way spool valve V, operated by a lever 92, is mounted upon a shelf 93 outstanding from the upper flange of I-beam 20 alongside the operator's platform 25 in a position which is easily available to the operator. The valve lever 92 is a three-position, spring-loaded type biased to a neutral position with fluid flow into the intake port 88 being directed to the discharge port 91 and without movement of the piston 35. Movement of the lever towards the valve body causes fluid flow into the intake port 88 to be discharged from a working port, for example port 89, into line 89'. At the same time, as the piston 35 moves, fluid flow from the line 90' is directed into the port 90 to be discharged from the discharge port 91 and to the return line 91'. Movement of the lever from the neutral position away from the valve body produces the opposite action with flow into line 90' and from 89' to reverse the piston movement. This type of 4-way valve is conventional, for example model No. V-42, Gresen Valve, manufactured by Gresen & Co. of Minneapolis, Minn., may be used.

The operation of the splitter mechanism is described as being manually controlled, for the operator must move the ram bar 32 from one end of the chamber to the other by shifting lever 92. This is necessary to permit firewood logs to drop into the chamber. It is important, however, that this movement of the ram bar 32 stop when it reaches an end of the chamber 30 and that a limit means be provided at the cylinder 36 or valve 92 to stop movement of the piston 35. The simplest limit control means are bypass bleeds 89" and 90" at the ends of the cylinder 36. When the piston moves to its extreme position within the cylinder, it moves past the bypass bleed 89" and there is an immediate drop of pressure within the cylinder even if the operator fails to return the lever 92 to its neutral position. This limit control means requires that a cylinder length be such that the length of the piston stroke is the same as the extent of movement of the ram bar 32 in the chamber and that the cylinder be carefully positioned with respect to the chamber 30. Other limit and control devices, such as limit switches which operate solenoids at the valve V, are available and may be easily incorporated into the apparatus and such devices are fully equivalent to the bypass elements 89" above described.

The conveyors C and D are conventional units and need not be described in detail. The supply conveyor C extends to the side of the frame F and over the top of the I-beam 20 to drop firewood logs into the splitter chamber 30. This conveyor C may include a framework 94 which carries a belt 95, rollers and shafts, not shown, and a motor 96. Spaced transverse slats 97 upstand from the belt 95 to hold the firewood logs in position as they are moved to the splitter mechanism. The discharge conveyor D extends longitudinally and horizontally under the frame F and from the discharge end thereof. This conveyor D includes a framework 98 which carries a belt 99, rollers and shafts, not shown, and a motor 100. A flared trough 101 above this conveyor directs split firewood dropping from the splitter S onto the belt 99. Skirt straps 102 depending from a transverse bar 103 near the bottom of the frame members and above the head end of the conveyor also deflect split firewood onto the belt 99.

These conveyors C and D are hydraulically operated. The motors 96 and 100 are in a circuit which includes the pump P' at the engine E and the valves V' and V" heretofore mentioned. Referring to FIGS. 1, 2 and 11, an intake line 104 extends from the fluid reservoir R to the intake part of pump P'. A pressure line 105 extends from the discharge port of pump P' to the intake port 106 of valve V'. The valves V' and V" are lever operated 4-way spool valves interconnected in tandem in a series circuit so that discharge flow from valve V' enters valve V" and a return line 107' extends from the discharge port 107 of valve V". The valve V' has working ports 108 and 109 from which lines 108' and 109' extend, respectively, to the opposite ports of the hydraulic motor 96 of the supply conveyor C. The valve V" has working ports 110 and 111 from which lines 110' and 111' extend to the opposite ports of the hydraulic motor of the discharge conveyor D.

The 4-way spool valves V' and V" are operated by levers 112 and 113, respectively, and this assembly is mounted upon a shelf 114 outstanding from the upper flange of the I-beam 20 alongside the conveyor C at a position which is easily available to the operator. Each valve lever, 112 and 113, is a 3-position holding type adapted to remain at the position to which it is set. When the levers are at their center positions the fluid flow through the valves is from the intake port 106 to the discharge port 107 with no flow to and no movement of the conveyors. Movement of the lever 112 towards the body of valve V' causes fluid flow from the intake port 106 to a working port, for example port 108, thence into line 108', through motor 96, into line 109', into port 109 and through valve V" to be discharged from port 107. This drives the motor 96 and conveyor C in one direction, for example, in a forward direction. Movement of the lever 112 away form the valve body reverses the flow through the lines 108' and 109' and reverses the motor and conveyor movement. Reverse movement is necessary only when the conveyor is stopped, as when it is clogged by excessive debris. Movement of the lever 113 of valve V" towards the valve body causes fluid to flow from valve V', into valve V" to a working port, for example port 110, into line 110', through the motor 100, into line 111, into port 111' and to be discharged from port 107. This flow drives motor 100 and conveyor D in one direction, for example, in a forward direction. Movement of the lever 113 away from the valve body reverses the flow through the lines 110' and 111' and reverses the motor and conveyor movement. Reverse movement is necessary as when debris clogs the conveyor. The valves V' and V" are conventional, and Model SP Gresen Valve, manufactured by Gresen Co. of Minneapolis, Minn. may be used.

The operation of the apparatus is apparent from the foregoing description. Firewood logs cut to length are placed on the conveyor C at a supply station, not shown. Movement of the conveyor brings the logs to the apparatus, one at a time. The spacing of the logs on the conveyor C is preferably such that they will be timed by the conveyor movement to reach the chamber 30 as a previous log is split and pushed out of the chamber. In this way it is unnecessary for the operator to stop the conveyor. A log is dropped into the chamber 30 with the ram bar 32 at one end of the chamber. It is to be noted that a spacer bar 115 over the chamber will limit the diameter of logs that can enter the chamber. The operator centers the log with respect to the splitter nave 75 using his foot in the stirrup 54 if necessary. He then shifts the ram bar 32 to the other end of the chamber. This pushes the log through the spider 39 as illustrated at FIG. 9. By that time, in normal operation, the conveyor C drops the next-in-line log into the chamber 30. The operator centers that log with respect to the other splitter nave 75 and then shifts the ram bar 32 back to its original position. During these operations, the discharge conveyor D is running to move the split firewood away from the apparatus.

While I have now described my invention in considerable detail by this disclosure of a presently preferred embodiment, others skilled in the art may devise and build alternate and equivalent constructions which are nevertheless within the spirit and scope of my invention. Hence I desire that my protection be limited, not by the constructions illustrated and described but only by the proper spirit of the appended claims.

What is claimed is:

1. In apparatus for splitting a firewood log into several pieces of firewood having: (a) a longitudinally extended chamber adapted to receive and hold a firewood log with its grain being oriented longitudinally therein and with the chamber having an open end through which the log can be discharged; (b) a ram means within the chamber adapted to be positioned at the end of the chamber opposite the open end and to forcibly move a firewood log placed in the chamber towards and through the open end; and (c) several knife blades traversing the open end of the chamber and arranged in a radial array to form a spider which engages and splits the firewood log a corresponding several pieces as it moves through the open end, the improvement comprising:

a pointed cylinder at the nave of the spider with the point outstanding from the knife blades of the spider and being directed towards the chamber to engage the end of a firewood log moving into the opening to penetrate and apply a spreading pressure on the end of the log before the knives of the spider engage the log.

2. The apparatus defined in claim 1, including a movable floor in the chamber adapted to be raised and lowered to center a log, vertically, thereon with respect to the point of the nave cylinder.

3. The apparatus defined in claim 1, including a floor in the chamber formed as a longitudinal trough to center a log thereon, laterally, with respect to the nave.

4. The apparatus defined in claim 2, wherein the floor is formed as a longitudinal trough to center a log, laterally, thereon with respect to the nave cylinder.

5. The apparatus defined in claim 1, wherein:

(a) both ends of the chamber are open to permit a log to be discharged from either end;

(b) a spider having a pointed cylinder at the nave thereof is positioned at each end of the chamber;

(c) said ram means includes a bar traversing the chamber; and, (d) means to move the ram bar is either direction from either end of the chamber to push a firewood log through the opposite end of the chamber and through the spider at that end.

6. Apparatus for splitting a firewood log into several pieces of firewood comprising:

(a) a pair of elongate, longitudinally extended frame members spaced apart to include space for a longitudinal, open ended chamber between them;

(b) a floor between that portion of the frame members which define the chamber to receive and support a firewood log dropped into the chamber from above the frame members;

(c) a longitudinally shiftable slide frame between the frame members substantially longer than the chamber, extended about the chamber and having an elongate side member adjacent to each frame member, and with portions of each side member defining a side of the chamber;

(d) a ram bar transversely extended across the chamber with its ends being connected to the side members of the slide frame;

(e) means to forcibly shift the slide frame from a first position with the ram bar at one end of the chamber to a second position with the ram bar at the opposite end of the chamber, whereby to push a firewood log within the chamber therefrom and out of the opposite end; and (f) a knife means tranversing the said opposite end of the chamber having a plurality of blades in a radial array to form a spider and a pointed cylinder forming the nave of the spider with the point being directed into the chamber to engage the end of a log moving against the spider before the knives engage the log to apply a spreading pressure on the end of the log and thereby facilitate a splitting action of the log.

7. The apparatus defined in claim 6 wherein a spider, having a cylindrical, pointed nave, is positioned at each end of the chamber and said means to shift the slide frame is double acting to forcibly move the ram bar from either end of the chamber to the opposite end thereof and thereby push a firewood log, within the chamber, through the spider at that said opposite end.

8. The apparatus defined in claim 7, including adjustment means supporting the floor in the chamber whereby the floor is vertically adjustable to be raised and lowered to facilitate centering a firewood log with respect to the nave point.

9. The apparatus defined in claim 8, wherein the adjustment means includes vertical guide means to hold the floor in position and counterweight means biased against the weight of a log on the floor to increase in force as the floor moves downwardly whereby to center, approximately, firewood logs of varying diameter with respect to the nave point.

10. The apparatus defined in claim 6, wherein each knife blade of the spider is held in position by an anchor means secured to its outer end and to the frame.

11. The apparatus defined in claim 10, wherein said anchor means includes a floor member between the frame members to which a lower knife blade of the spider is connected and an arched member extended over the frame members to which an upper knife blade is connected.

12. In a log splitting apparatus, a splitter head adapted to split a firewood log into several pieces and comprising:

(a) a radial array of a corresponding several knives forming a spider;

(b) a supporting frame means extended about the array to connect with the outward end of each knife; and (c) an elongated support member at the nave of the array connecting with the inward end of each knife; and (d) a pointed, cone-like end on said member extending ahead of the edges of the knives, whereby a log moving against the splitter will first engage the point and the cone-like end will then penetrate the end of the log to produce an outward, radial wedging action in the log by the spreading pressure of the solid-surface of the cone-like end, all before the knives commence splitting the log.

13. In the apparatus defined in claim 12, wherein the splitter head is formed with five knives.

14. In a log splitting apparatus, a splitter head adapted to split a firewood log into several pieces and comprising:

(a) a radial array of a corresponding several knives forming a spider;

(b) a supporting frame means extended about the array to connect with the outward end of each knife; and (c) an elongated central support member to which the blade members are welded at a radial outward location, disposing the elongated central support member at the central axis of the array;

(d) said elongated central support member having a conical end portion with a solid continuous peripheral surface extended from the support member and located in front of the blade members whereby a log moving against the splitter will first engage the point of the conical end portion and as the conical end portion penetrates the log, the spreading pressure of the conical end portion will produce an outward radial wedging action in the log to facilitate splitting action as the knives engage the log.

15. In an apparatus for splitting a firewood log into several pieces having: (a) a longitudinal, open ended chamber whereinto a firewood log is dropped; (b) a ram means adapted to push a firewood log longitudinally from an end of the chamber; and (c) a spider of splitting knives traversing said end to engage the end of a firewood log as it is pushed from the chamber, the improvement comprising:

(a) a floor in the chamber formed with a central, longitudinal trough adapted to align and center, a firewood log, laterally, with the nave axis of the spider;

(b) a vertical guide means within the chamber holding the floor in position, longitudinally, but permitting the floor to raise and lower within the chamber; and (c) an adjustment means supporting the floor and a firewood log thereon, adapted to raise and lower the floor in the guide means and including load compensating means responsive to the varying weight of firewood logs of varying diameter to shift the floor to a position where the center of a firewood log is in substantial vertical alignment with the nave axis of the spider.

16. The apparatus defined in claim 15 wherein the adjustment means includes a weighted lever arm adapted to swing outwardly from a steeply inclined position and upwardly to approach a horizontal position, and a linkage means interconnecting the floor and the level arm to lower the floor as the lever arm swings outwardly and upwardly whereby to apply an increasing upwardly force against the floor as the lever arm leverage increases responsive to the outward and upward swing.

* * * * *